US006299656B1

(12) United States Patent
Richardson, Jr. et al.

(10) Patent No.: US 6,299,656 B1
(45) Date of Patent: Oct. 9, 2001

(54) NON-FOSSIL FUEL ADDITIVES FOR PREDOMINANTLY HYDROCARBON FUELS

(75) Inventors: William H. Richardson, Jr., Largo; James A. Wilcox; Douglas A. Palmer, both of Sarasota, all of FL (US)

(73) Assignees: Charles A. McClure, Tampa; as trustee of his 1999 trust; Arcall, L.L.C., Clearwater, both of FL (US)

( * ) Notice: Subject to any disclaimer, the term of this patent is extended or adjusted under 35 U.S.C. 154(b) by 0 days.

(21) Appl. No.: 09/221,803

(22) Filed: Dec. 29, 1998

(Under 37 CFR 1.47)

(51) Int. Cl.[7] ..... C10L 10/00
(52) U.S. Cl. ..... 44/603; 44/620; 44/628; 44/641; 123/3; 123/DIG. 12
(58) Field of Search ..... 44/603, 620, 628, 44/641

(56) References Cited

U.S. PATENT DOCUMENTS 3,409,420 * 11/1968 Booth ..... 44/603
3,781,171 * 12/1973 Maccaferri ..... 44/603
4,440,100 * 4/1984 Michelfelder et al. ..... 44/603
5,435,274 * 7/1995 Richardson, Jr. ..... 123/3
5,692,459 * 12/1997 Richardson, Jr. ..... 123/3
5,792,325 * 8/1998 Richardson, Jr. ..... 204/164
5,826,548 * 10/1998 Richardson, Jr. ..... 123/3

* cited by examiner

*Primary Examiner*—Ellen M. McAvoy

(57) ABSTRACT

Non-fossil gaseous fuel, evolved in underwater carbon arcing, and characterized by significant heat content and substantial freedom of its combustion effluents from noxious gases and/or particulates, is similarly useful in whole or part as an additive to predominantly hydrocarbon fuels—whether in bulk storage or transport, flowing in a pipeline, fueling a cutting/welding torch, or fueling an internal-combustion engine. Dosing a predominantly hydrocarbon fuel with all or a selected part of such gaseous fuel mixture inhibits leakage and substantially diminishes noxious effluent gases and particulates as characteristic of the combustion of predominantly hydrocarbon fuels.

20 Claims, 7 Drawing Sheets

20
24
26
41
44
22
24

20
24
26
48
47
28
29
18

11
13
14
15
12
21
20
42
24
23
22
25
17
16
59
44
41
47
26
27
18
29
28

NON-FOSSIL FUEL ADDITIVES FOR PREDOMINANTLY HYDROCARBON FUELS

TECHNICAL FIELD

This invention concerns fuel additives for internal-combustion engines and of noxious components in combustion effluents.

BACKGROUND THE INVENTION

Predominantly hydrocarbon fuels, whether in gaseous, liquid, or solid (usually pulverized) form, are noted for combustion effluents of harmful or noxious nature, such as carbon monoxide, particulates, and other by-products of incomplete combustion. Operation of such engines on hydrogen and air (or oxygen) sounds good, but hydrogen is not the ideal fuel it has seemed to be because engines operated on it attain such high temperatures as to flash back through the intake valves and thereby to preclude proper timing and to foster formation of noxious nitrogen oxides (aptly called $NO_X$) in their effluent.

Organic origins of predominantly hydrocarbon fuels endow them with such ranges of molecular compositions and molecular sizes that their complete combustion while altogether is notably problematical. Attempts to provide a suitable range of combustion environments to accommodate such diverse combustible components have complicated the design and control of air and fuel inflow, admixture, and exhaust.

This invention does not undertake to extend that work, but to modify the fuel itself to render it more amenable to complete combustion, by providing a fuel additive—or additive fuel—noted for the unparalleled completeness of its combustion and the freedom of its effluent from the harmful contaminants common to the combustion effluents of predominantly hydrocarbon fuels. This phenomenal fuel, or fuel additive, also has the desirable characteristic of resisting leakage through imperfect tubing or pipeline joints or valves, for related reasons that are only gradually becoming better understood.

SUMMARY OF THE INVENTION

A primary object of the present invention is to provide a fuel additive, to improve the utility of predominantly hydrocarbon fuels.

Another object is to safeguard predominantly hydrocarbon fuels from loss by leakage during transport through pipelines or the like.

A further object of this invention is to improve the operation of internal-combustion engines on predominantly hydrocarbon fuels.

Yet another object is to provide a fuel additive—itself a fuel.

In general, the object of this invention are accomplished by providing a fuel additive, itself a non-fossil fuel, characterized by substantially non-polluting combustion effluent and by ability to decrease the polluting effluents of predominantly hydrocarbon fuels, such as in transport to eventual use locations, or in admixture with such fuel before or after entry into an internal-combustion engine.

More particularly, this fuel additive is produced as a gaseous mixture evolved in water surrounding an electric arc and with carbon supplied thereto, preferably at least in part via carbon electrodes. This evolved non-fossil gaseous mixture, itself useful as a fuel, may be supplied as an additive, or it may be fractionated to extract its small molecular components (mainly hydrogen and carbon monoxide) to leave, for use as such an additive, aggregates of some or all its constituent elements (carbon, hydrogen, oxygen) somehow bound otherwise than by traditional chemical molecular bonding, but presumably electromagnetically, and conveniently called "magnecules" here.

Addition of this fuel/additive to a gas pipeline, in an amount of about several percent (by volume) of gas being transported, can safeguard the pipeline from loss, as by physical leakage at joints, probes, valves, or other access to or outlet from the pipeline.

Injection of this fuel/additive to a predominantly hydrocarbon fuel for an internal-combustion engine, in an amount of at least about several percent of such fuel, can improve combustion of the fuel, reduce its content of harmful, noxious, undesirable materials present in combustion effluent from such internal-combustion engine.

Other objects of this invention, together with methods and means for attaining the various objects, will become apparent from the following description and accompanying diagrams of one or more embodiment(s), presented by way of example rather than limitation.

DESCRIPTION OF THE INVENTION

Figure 1:
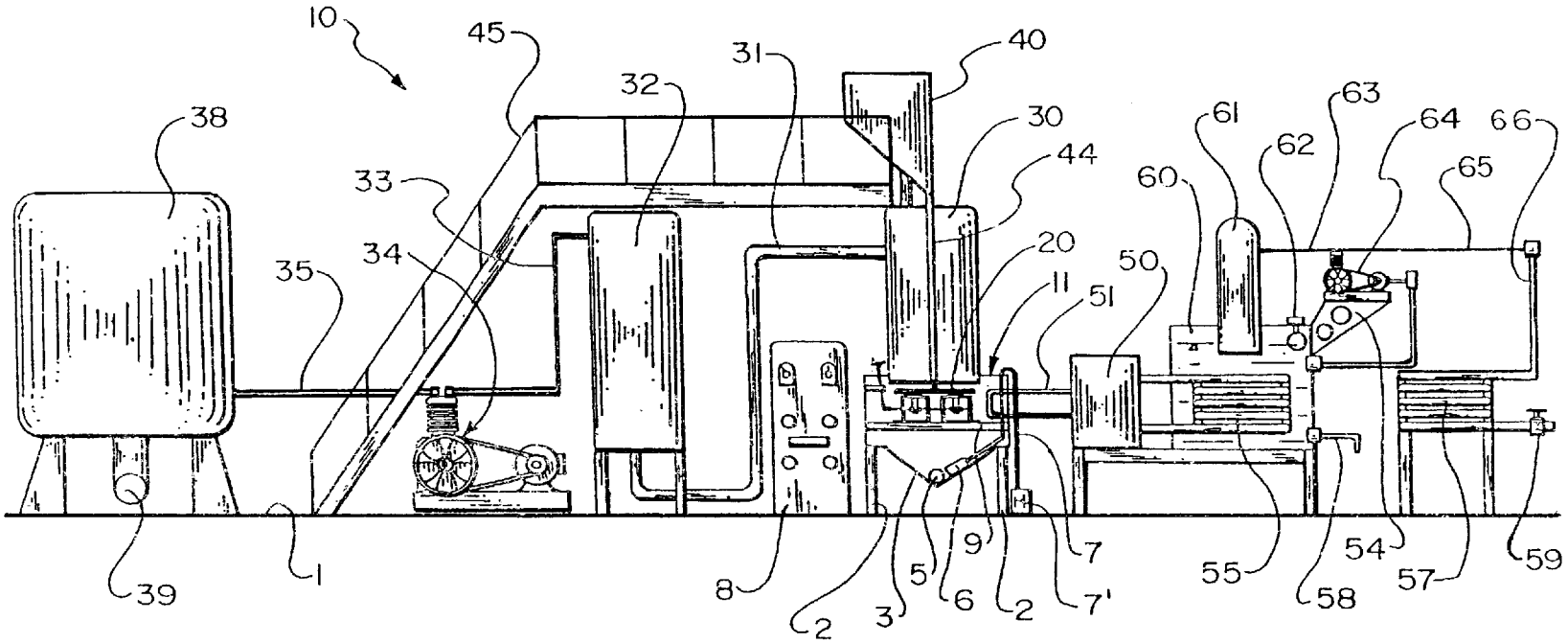
FIG. 1 is a side elevation, partly sectioned or cut away, of an embodiment of manufacturing plant for fuel of the present invention.

FIG. 1 shows in rather schematic side elevation, a first embodiment of fuel manufacturing plant 10 of this invention, viewed as three main areas: reactor and production at the right center, collection and storage at the left, and temperature control and distillation area at far right—all from an observer's point of view.

Prominent in the FIG. 1 production area are reactor assembly 11 (partly cut away or sectioned to reveal its interior) and electrical supply equipment 8 upright on the floor alongside it. Reactor bed 3 slopes down to its center, which is provided with drain outlet 5 and with sludge pump 6 connected by sludge line 7 to collection can 7'. Horizontal baffle 9 well above the bed supports electrode assembly 20 immersed in water (invisible here) nearly filling the reactor. Hood 30 overlies the electrodes and extends thereabove to collect fuel gas evolved from the water (not indicated here) in the reactor.

At mid-left, stairway 45 leads from the floor up and over to rod-holding magazine 40, loadable from time to time with consumable carbon rods (not shown here) to be fed downward via discharge tube 44 and out endwise between the respective electrodes of assembly 20. At the left of the reactor, collection line 31 leads from hood 30 to segregation tank 32, which prevents entrained water and particulates from contaminating the collected fuel. Line 33 leads therefrom to compressor 34, which forwards the collected gas to storage tank 38, having underneath it valved gas outlet 39, available for connection to transportable tanks—or intervening pipeline—to user locations.

Toward the right in FIG. 1, heat pump assembly 50 connects loop 51 in the reactor to larger loop 55 in tank 60 filled with water. Hood 61 overlying that tank has exhaust line 63 leading from it to to evacuation compressor 64 mounted on bracket 54 attached to the tank and actuated by temperature sensor 62 in the top of the tank. The compressor discharges into hot air/steam line 65 connected to line 66 down to condenser 57 with drain tap 59 below (at far right).

Figure 2C:
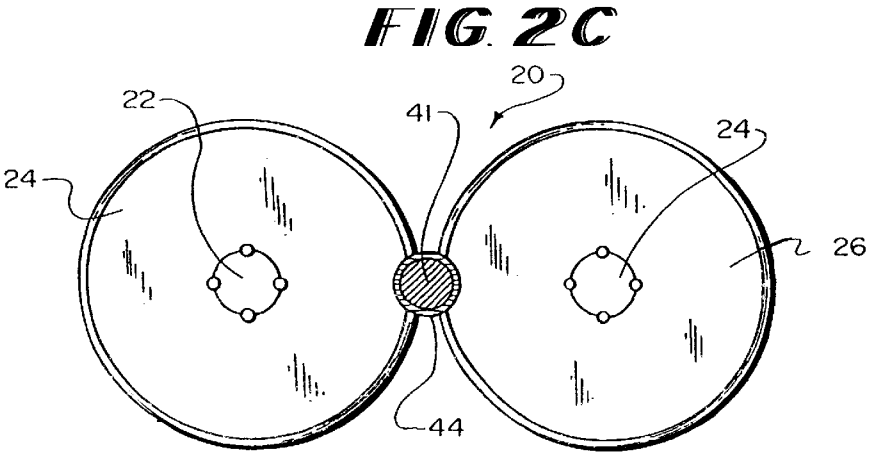
FIGS. 2A, 2B, and 2C are, respectively, side elevation and end elevations, and top plan, of FIG. l's underwater electrode assembly.
Figure 2B:
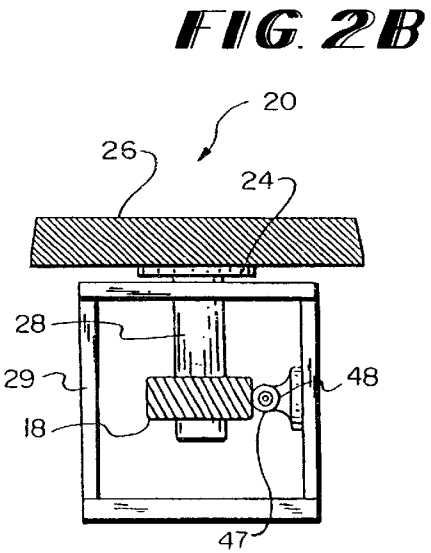
Figure 2A:
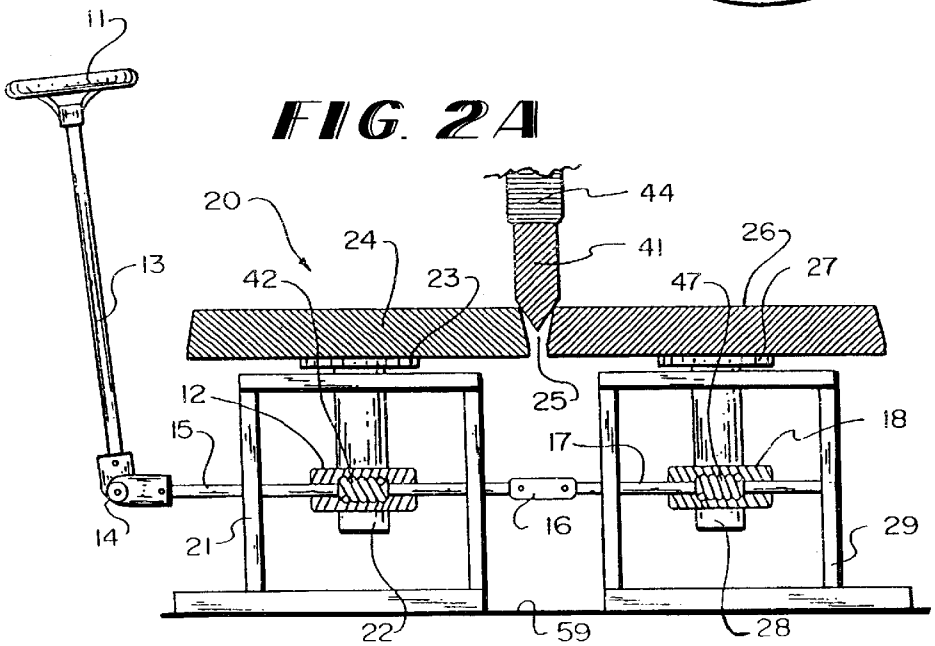

FIGS. 2A, 2B, 2C show exemplified electrode assembly embodiment 20, from the side, end, and top, respectively. As seen most fully in FIG. 2A, twin stands 21, 29 rise upright from baffle 9, to support axles 22, 28 in bearings (not shown) in the horizontal tops of the stands. Disk-like electrodes 24, 26—on enlarged holders 23, 27 on the tops of the axles—form gap 25 at the closest approach to each other. The peripheral edges of the disks are tapered so that at their top the perimeter is less than their bottom perimeter. Intruding, from above, down into the gap and into contact with edges of both electrodes is rod end 41 (also shown tapered here) emerging from discharge tube 44 of magazine 40 (hidden here). The axles also carry at their lower ends, within the respective stands, respective pinion gears 12 and 18 engaged by drive gears 42 and 47, carried on respective bracket-supported bearings (48 shown here for gear 28) for aligned shafts 15 and 17 interconnected by swivel 16. The shafts interconnect via universal joint 14 to shaft 13 and are rotatable by turning crank handle 11 (top left), which is a manual implementation of optional automated embodiments (not shown here).

Operation of the foregoing embodiment is understood readily, as summarized below. Reference numerals are now omitted as superfluous. The electrode disks are assembled to their respective axles and the reactor is filled with enough water to submerge the electrodes. With AC or DC energizing electricity in the range of about 50 v. to 100 v. applied to the electrodes,the first conductive rod is lowered toward the gap between the pair of electrodes, and when the rod tip gets close enough an arc bridges the electrodes. Bubbles evolve from the arc and rise to the surface of the water. The gaseous contents of the bubbles collect under the hood and are pumped from there through a segregation tank to a large tank for storage under a pressure up to several thousand p.s.i. or a couple hundred kg/cm$^2$.

The water in the reactor tends to get progressively hotter but is kept relatively cool, preferably about 1400° F. (600° C.) by heat-exchange in the temperature-control system. This enables generation of steam for whatever use and the condensation of potable water from the steam whether formed from brackish, polluted, or even sea water.

Both the conductive rod and the electrodes are consumed bit by bit by the electric arc, as is the water, whose level is maintained above the arc by added water or recirculation of steam condensate. The rods are consumed relatively rapidly and are fed in succession from the magazine above the reactor. The electrodes being consumed more slowly, may be rotated, either intermittently as in the first or continuously, to distribute their erosion evenly along their peripheral edges. Rotation of the electrodes about either vertical or horizontal axes (or alternatively about oblique axes) rotates the rods by contact so they also erode evenly. When the electrodes have eroded close to their axles, the reactor is shut down temporarily to enable electrode replacement and any needed reactor maintenance.

Figure 3:
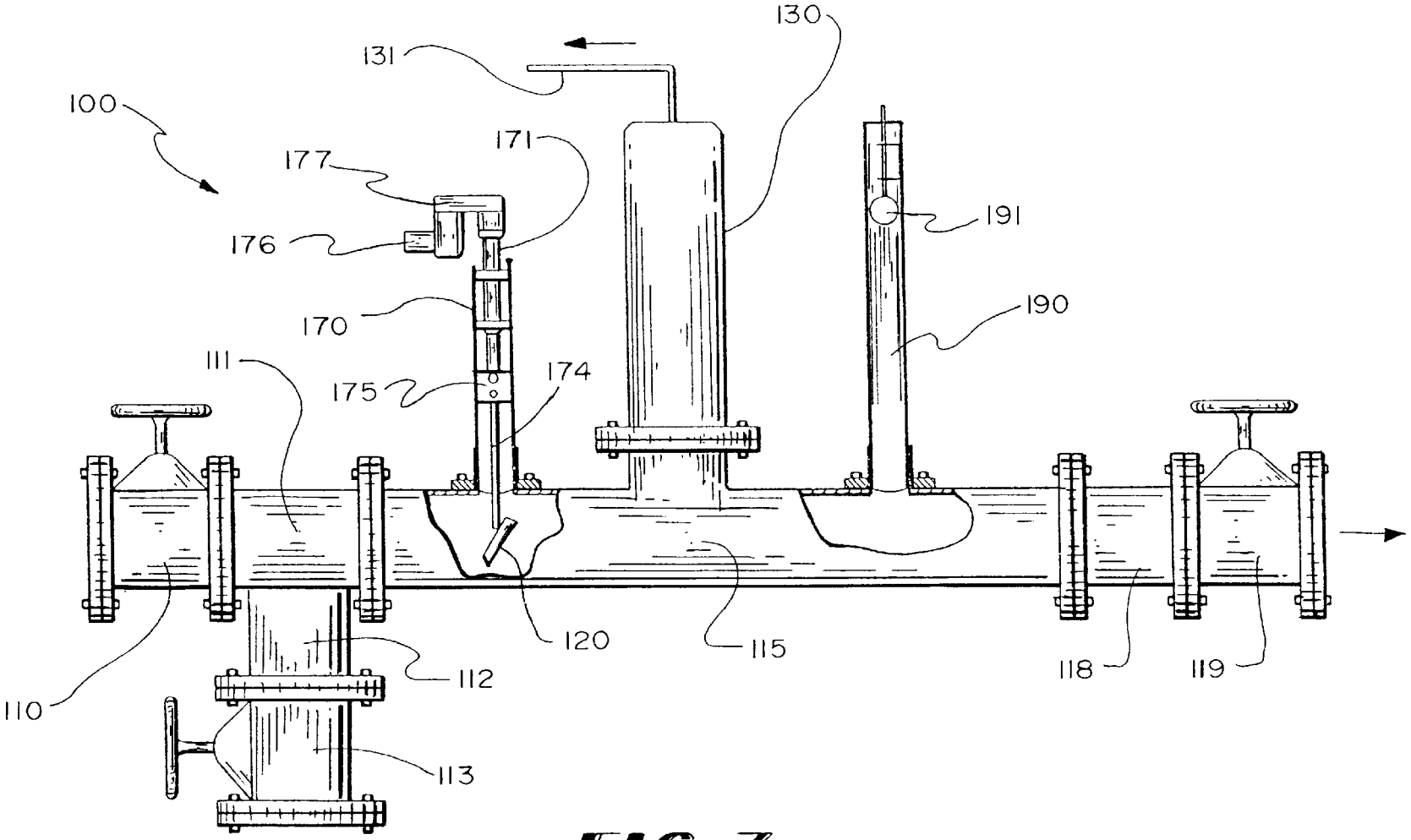
FIG. 3 is a side elevation, of a pipeline-adjunct embodiment, also partly sectioned or cut away, to reveal reactor componentry.

Whereas the foregoing gas-evolving embodiment has utilized a reactor with a water surface open to the ambient atmosphere, such an arrangement may be replaced by a closed reactor for operation within piping customarily filled with water as in the following views. FIG. 3 shows, in side elevation, partly sectioned or cut away to show interior components, pipeline-adjunct embodiment 100 of this invention, featuring horizontal piping having water (or wastewater) inlet flow valve segment 110 at the left, followed by inverted T-section connected to solids discharge valve segment 113 (openable downward) as well as to long horizontal intermediate piping segment 115, followed by short interconnecting segment 118, plus outlet flow valve segment 119 at the right end. Overhead components are connected successively to the piping—mainly to accommodate evolved gas, rather than the components from which it evolves—and include (i) control housing 170 (left of midview) overlying in-pipe electrode assembly 120; (ii) upright reactor product hood 130 midway, with outlet tubing 131 leading away (leftward) at its top; and iii) pressure-sensor housing 180, which may be translucent, with weight 128 adapted to rise and fall therein, supported at variable height dependent upon the pressure of gas underlying it.

The contents of control housing 170 include rod feeder 171 at its open top, and vertical carbon rod 174 held (and fed) thereby downward through piston-like sealing spacer 175 into piping intermediate valve segment 119, juxtaposing its forward end to preferably graphite electrodes 120, secured in fixed position within the piping by any suitable means located therein (accordingly not shown here).

Gap-voltage-responsive device 176, at the top, measures the voltage across the spark gap between the electrodes, and drive 177 feeds the rod downward to maintain proper voltage across the spark gap, where the arc tends to erode the electrodes, as well as the rod itself. Such control devices are well known and are commercially available. Electrical connections are understood here (rather than shown), being only a conventional adjunct to the inventive aspects.

Hood 130 collects, and provides temporary storage for, gaseous product evolved in the vicinity of the underwater arc across the spark gap. A control valve (not shown) is useful in outlet tubing 131 to allow release of gas for use or storage elsewhere.

The weighted pressure sensor 191 in hoodlike housing 190 is preferably capable of being visually observed, as an indicator of the pressure of the evolved gas, and is connected to operate high-pressure arc-voltage cut-off means (not shown) to guard against excessive gas pressure. A bleed valve (not shown) is desirable to let out air as water initially enters the piping. Also desirable is a pressure relief valve to preclude dangerous overpressure—as a precaution, if overpressure arc-voltage cut-off means should fail.

Figure 4:
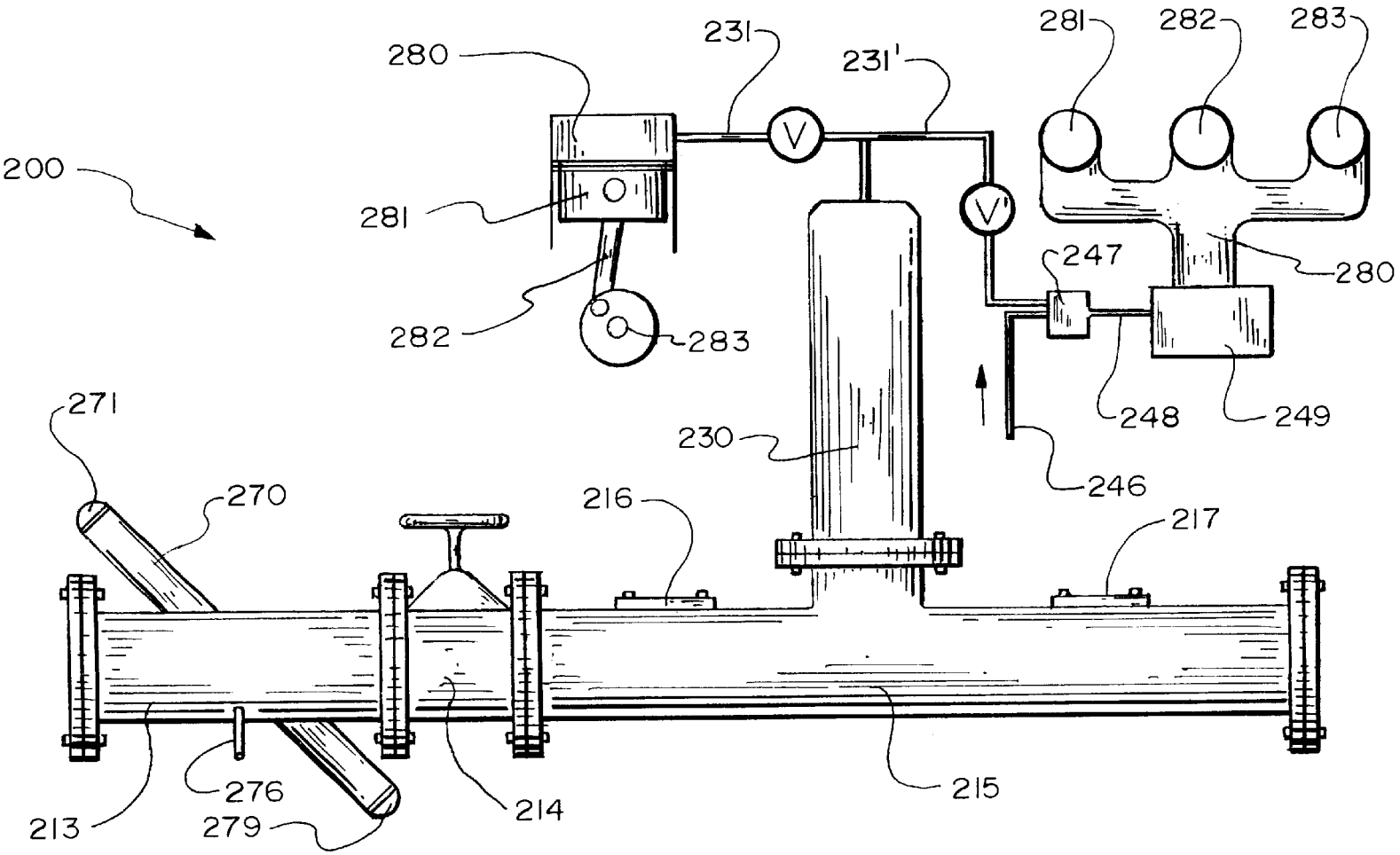
FIG. 4 is a part-schematic side elevation of a second pipeline-adjunct embodiment illustrating internal-combustion engine uses.

FIG. 4 schematically shows internal-combustion (IC) engine use of embodiment 200, a variant of pipeline-adjunct unit 100 of FIG. 3, with the left and right hoods now superseded by covers 216 and 217.

Outlet tubing branch 231, containing control or regulator valve V, connects to cylinder 280 (shown fragmentarily) containing piston 281 on connecting rod 282 pivotally secured by connecting rod 282 to drive shaft 283. This showing is representative of an IC engine fueled by gaseous product of the present invention. Alternative outlet tubing branch 231' (with valve V') connects to mixing head 247, as does incoming fuel tubing 246 from a predominantly hydrocarbon fuel source (not shown). Tubing 248 connects from the mixing head to optional carburetor (or adapter) apparatus 249, whose gaseous output enters manifold 280 and is distributed to an engine (not further shown) via branches 281, 282, and 283—conventionally serving two cylinders each (also not shown). This showing is representative of an IC engine fueled by gaseous product of the present invention injected into and thus mixed with a predominantly hydrocarbon fuel.

The previous vertical housing at the left of the large hood is replaced here by slanted tubular rod-holding housing 270, with top and bottom end caps 271, 279. Also shown is electrode support 276.

Figure 5B:
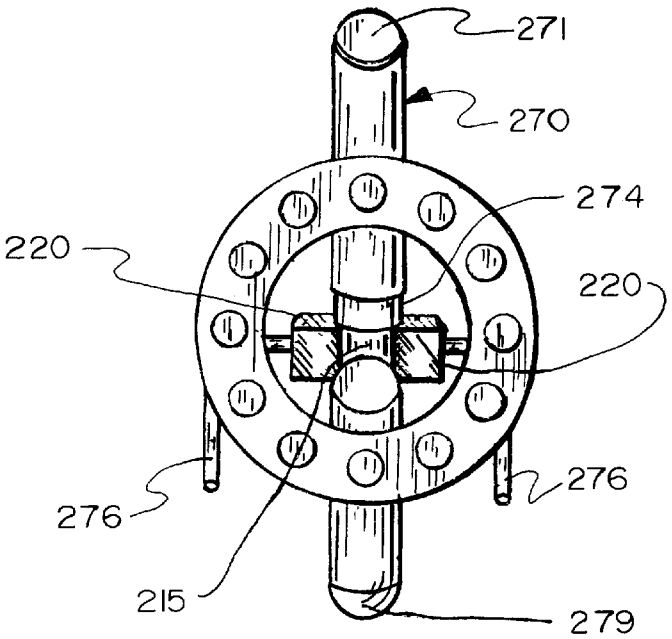
FIGS. 5A and 5B are, respectively, a side elevation, partly cut away, and an end elevation of a pipe segment, of the embodiment of FIG. 4, including an electrode assembly different than in FIG. 3.
Figure 5A:
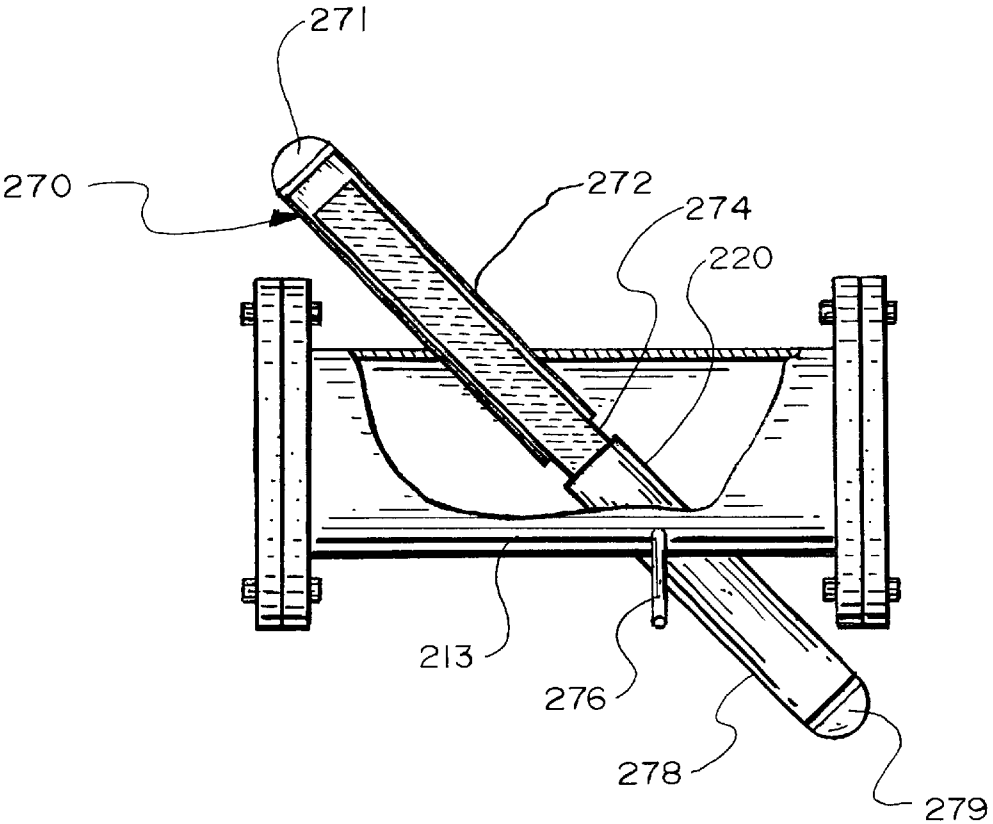

FIGS. 5A and 5B show electrode assembly 220 and surroundings of the FIG. 4 embodiment: FIG. 5A viewing leftmost pipe segment 213 in enlarged side elevation, partly cut away; and FIG. 5B viewing the same pipe segment in end elevation, looking rightward into FIG. 5A.

FIG. 5A shows pipe segment 213 cut away to reveal the upper end portion 272 of intersecting tubular rod holder 270 oriented obliquely (left to right) from above to below the pipe and having removable top and bottom end caps 271 and 279. The holder's top half is cut away to reveal carbon rod 274 inside. The right electrode of the usually graphitic carbon electrode pair 220 is only partially visible edge-on here and conceals the left electrode, visible later.

FIG. 5B shows pipe segment 213 end-on, with spark gap 21 between pair of electrodes 220 retained by pair of holders 276, 276.—whose adjustable ends protrude outside the piping and downward.

During operation of this apparatus, the carbon rod and—to a lesser extent—the electrodes are pyrolyzed when the arc is struck. The rod moves gradually downward as it is consumed, and fragments of it fall into the bottom of the holder, from which they are removable by removal of the bottom end cap. When a carbon rod is consumed, a new rod is inserted into the top of the holder and fed down until it meets the electrodes at the spark gap. Automatic feeding equipment from a magazine holding many rods may be utilized as noted before.

Figure 6:
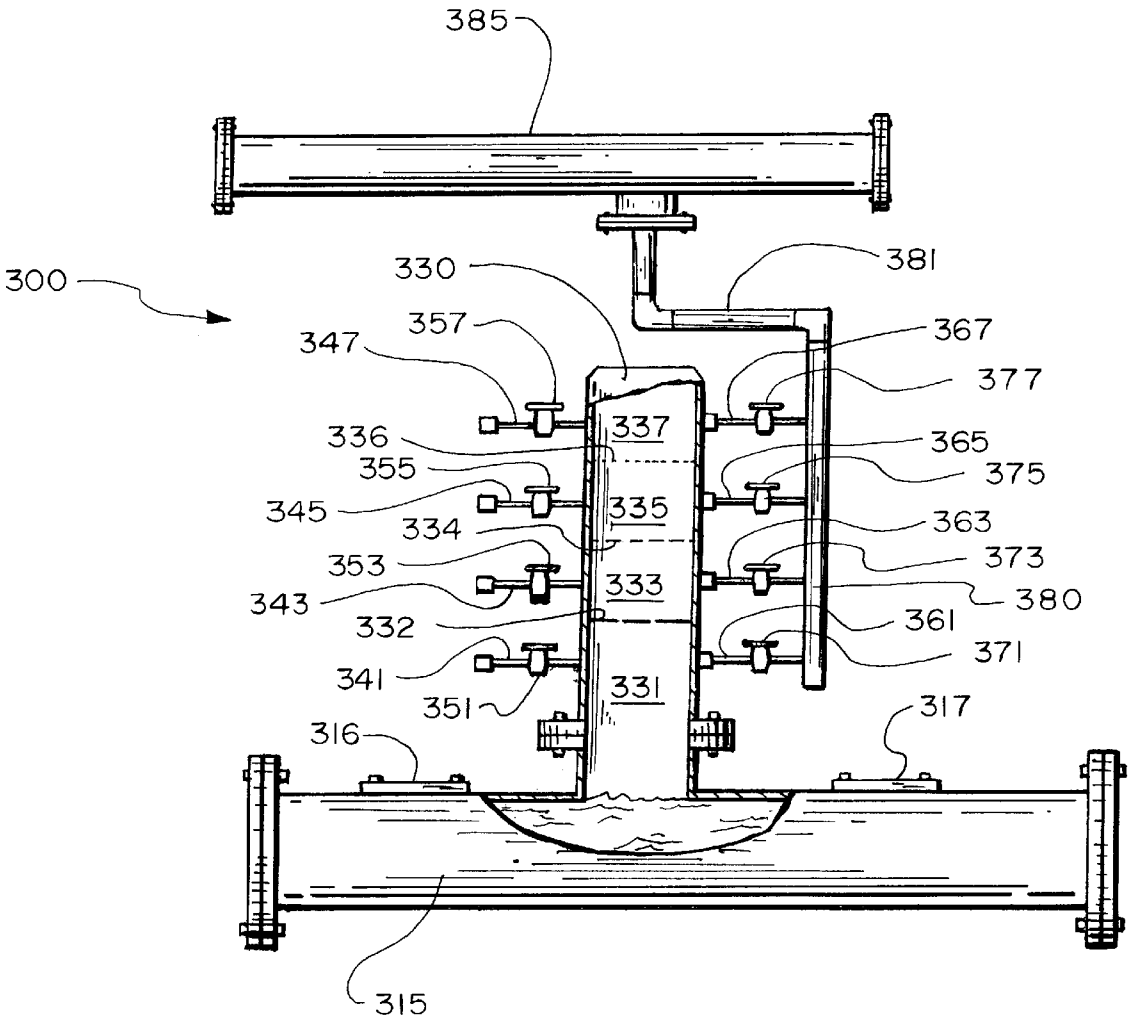
FIGS. 6 is a side elevation, partly cut away, of pipeline-adjunct apparatus of this invention including means for fractionating the gaseous product as a fuel and/or as a fuel additive.

FIG. 6 shows, in side elevation, embodiment 300 of the present invention including collecting hood 330, modified from hood 230 of previous embodiment 200 by being compartmented by a succession of semi-permeable membranes. Its purpose is to fractionate the gaseous product of this invention, for use as one or more separate fuels or fuel additives, such as for predominantly hydrocarbon fuels.

Modified hood 330, here exemplified as a modification of pipe-adjunct reactor apparatus, is applicable as well to the reactor of FIG. 1, in which the water surface is open to the ambient atmosphere, and alternatively is applicable to a free-standing equivalent thereof sealed off from the atmosphere, as may be preferred so as to facilitate feeding pressurized intermediate or end-use apparatus.

Hood 330 receives bubbles of the gaseous mixture evolving from the underwater carbon arc (not shown here) from the indicated water into its base opening. The hood is subdivided at successive levels into four compartments: (i) the first or lowest compartment, 331, bounded below by the water and bounded above by fine membrane 332; (ii) the second compartment, 333, bounded below by membrane 332, and bounded above by finer membrane 334; (iii) the third compartment, 335, bounded below by membrane 334, and bounded above by finest semi-permeable membrane 336; and (iv), the fourth and last compartment, 337, bounded below by membrane 336 and by the top (and sides, of course) of the hood.

Each of compartments 331, 333, 335, and 337 has corresponding outlet fittings, at left and right, respectively: lowest (or first) compartment 331 has left outlet 341 with valve 351, and right outlet 361 with valve 371; next (or second) compartment 333 has left outlet 343 with valve 353, and right outlet 363 with valve 373; next (or third) compartment 335 has left outlet 345 with valve 355, and right outlet 365 with valve 375; and topmost (or last) compartment 337 has left outlet 347 with valve 357, and right outlet 367 with valve 377.

The outlets at the left are free-standing, available for single or multiple connection to one or more collection devices or to one or more use devices, e.g., IC engines, cutting or welding torches.

The outlets at the right join manifold piping 380, which leads via connecting pipe 381 to large pipeline 385, which may already contain a predominantly hydrocarbon fuel or may be a pipeline to convey all or part of the mix resulting from the present invention elsewhere.

If all of the valves at the right (to the pipeline) are closed, and all the valves at the left, except lowermost valve 351, are open, fractionation of the evolved product mix will occur. The top compartment will collect, and be able to output via outlet 347, the component gas having the greatest ability to traverse the increasingly fine semi-permeable membranes, in this instance only hydrogen. The immediately preceding compartment will collect, and be able to output via outlet 345, product gases of intermediate kinetic gas diameter, which passed readily through least fine membrane 332 but found finer membrane 334 an obstacle, here mainly carbon monoxide. Compartment 333, the lowest compartment bounded by two membranes, will collect and be able to output the remaining bulkier components.

Thus, pipeline 385, or other intended use apparatus/location, may receive either the complete product mix evolved according to the underwater electric arcing of this invention, or only some selected component(s) thereof, whichever may be preferred. For reasons to be considered below, the choicest additive may be the component(s) that predominate in the first (333) of the two-membrane compartments.

Figure 7:
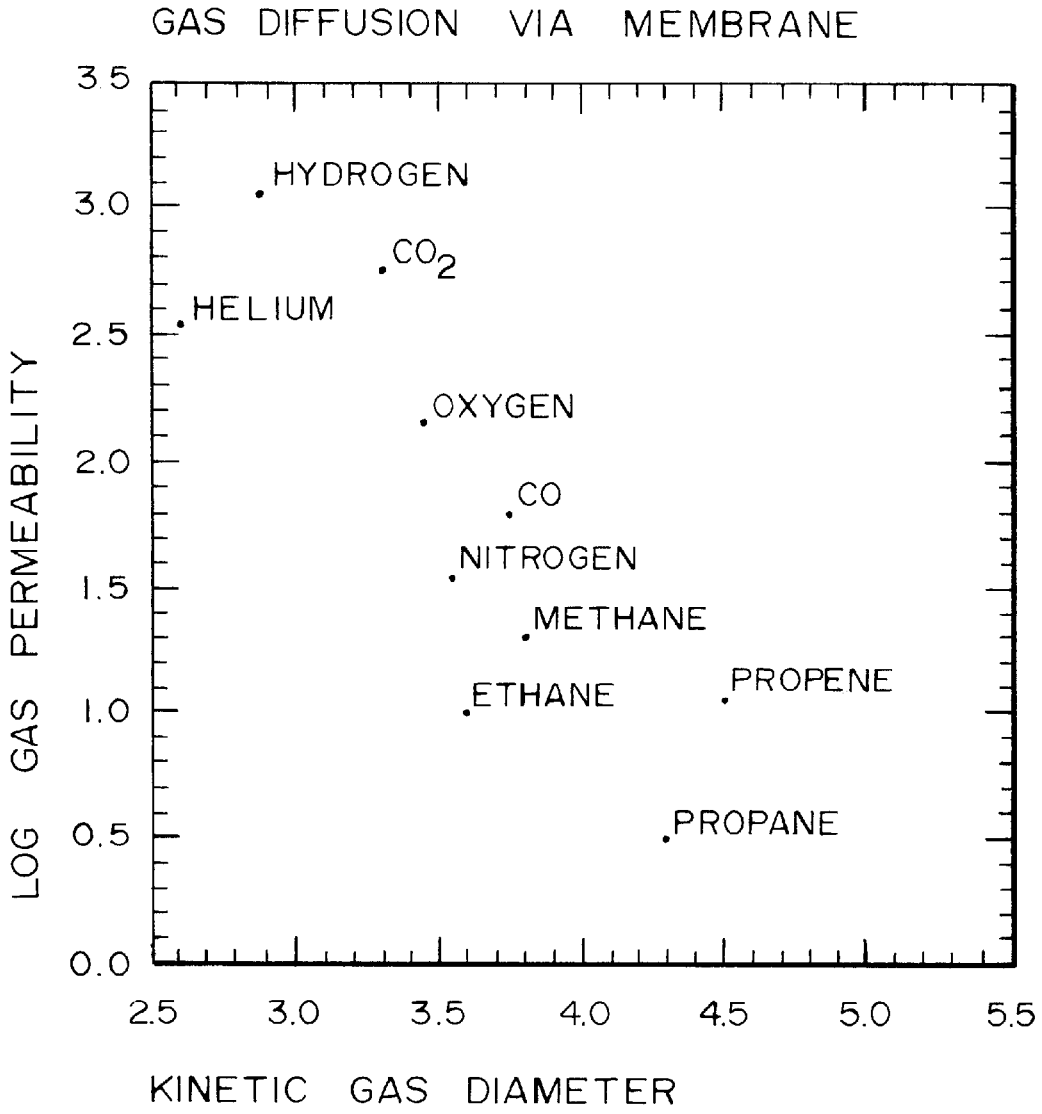
FIG. 7 is a graph of permeability vs. kinetic gas diameter, for gaseous compositions of this invention and some hydrocarbons.

FIG. 7 shows a graph of permeability vs. kinetic gas diameter, for ten gaseous compositions, including a couple of this invention, and some hydrocarbons. For each gas, its permeability's ($\log_{10}$) is plotted against its kinetic gas diameter to suggest how differential diffusion via semi-permeable membranes enables separation of gases. The smaller and lighter gases cluster in the upper left, whereas the larger and heavier gases disperse lower and/or further to the right.

Not all semi-permeable membranes are alike, and membranes of diverse compositions may have unlike effects upon certain gases for chemical and/or electromagnetic reasons not yet fully understood. (The exemplified location of $CO_2$ in this graph may be anomalous or may result from tailoring of a particular membrane for such effect.)

Such graphical showing aside, empirically observed diffusion of the gaseous mixture obtained by underwater carbon arcing has shown drastic (order-of-magnitude) differences in diffusion rates/times. Thus, with a single semi-permeable membrane (helium-grade balloon) enclosing the as-produced mixture, at least one prominent component (notably, hydrogen) diffused through it in several hours; one or more presumably larger gases (predominantly, carbon monoxide) took several days, whereas several months later some of the mix was still holding the balloon partially inflated. Empirical observation also revealed a leak-resistant quality when the gaseous product mixture was stored under appreciable pressure in a gas cylinder from which air leaked much more readily. The mixture was also observed to clog tubing of laboratory (e.g., gas spectroscopic) equipment. Qualified laboratories in Europe and the United States have confirmed presence of large/heavy constituents not conforming to any known compounds, for which the term "magnecules" has been suggested, based upon some theoretical considerations advanced by an eminent physicist familiar with sub-nuclear compositions and reactions. Whatever the technical aspects, knowledge of them is not essential to the practice of this invention as presented in the accompanying description and diagrams.

Hence, fuel gas pipelines can be rendered less susceptible to loss from leakage by being dosed with an effective amount of such a gaseous mixture obtained from such underwater carbon arcing, or only with the heavy or magnecule-rich fraction thereof, equivalent to at least about several percent by volume of the treated pipeline gas.

Moreover, the noxious effluents from predominantly hydrocarbon gases can be greatly reduced by dosing with the gaseous product of such underwater carbon arcing, or such heaviest fraction. Also the particulate effluent from a diesel engine, or an old gasoline engine can be similarly greatly reduced by such dosing. No observer of the such dosing can deny the immediately observable (aurally, nasally, and visually) resulting benefits in the immediate vicinity.

Adoption of this invention for fuel of new automotive vehicles would enable them to meet strict IC effluent environmental standards and would ameliorate the ill effects from older vehicles if adopted.

Preferred embodiments and variants have been suggested for this invention. Other modifications may be made, as by adding, combining, deleting, or subdividing compositions, parts, or steps, while retaining at least some of the advantages and benefits of the present invention—which itself is defined in the following claims.

What is claimed is:

1. Method of reducing leakage of predominantly hydrocarbon (HC) fuels by the step of adding to a leaky container of a volume of such HC fuel a non-fossil gaseous leak-limiting fuel composition evolved by electrical arcing across an underwater spark gap having solid carbon present therewithin.

2. Method according to claim 1, wherein the predominantly hydrocarbon fuel gas is in storage or in transit, and an objective is to reduce loss by leakage thereof, effective amount of the additive is about several percent by volume of the gas to be protected from leakage.

3. Method according to claim 2, wherein the additive is introduced into a container for storage of the hydrocarbon fuel.

4. Method according to claim 2, wherein the additive is introduced into a pipeline for transport of the hydrocarbon fuel.

5. Method according to claim 1, wherein the predominantly hydrocarbon fuel is about to be combusted with addition of air, and an objective is to improve its completeness of combustion, by reducing noxious materials in the fuel's combustion effluent.

6. Method of improving hydrocarbon combustion, comprising the step of adding to a hydrocarbon fuel for combustion a non-fossil fuel evolved in gaseous form by underwater carbon arcing.

7. Method according to claim 6, including the step of introducing the additive into the hydrocarbon fuel at simultaneous entry into the combustion chamber of an internal-combustion engine.

8. Method according to claim 6, wherein the hydrocarbon fuel is normally gaseous, and including the step of selecting it from the following compositions: (a) lower alkane, (b) lower alkene, (c) coal gas, (d) natural gas.

9. Method according to claim 6, wherein the hydrocarbon fuel is normally liquid, and including the step of selecting it for one of the following suitable uses: (e) aviation fuel (f) diesel fuel, (g) gasoline-powered engine fuel, (h) heating oil.

10. Method according to claim 6, wherein the hydrocarbon fuel is normally solid and is pulverized for combustion, including the step of selecting it from one or more of the following compositions: pulverized (i) anthracite coal, (j) bituminous coal, (k) lignite.

11. Method according to claim 6, wherein the fuel evolved by underwater arcing comprises (i) hydrogen, (ii) carbon monoxide, and (iii) magnecules.

12. Method of operating an internal-combustion engine with fuel produced by the method of claim 11.

13. Predominantly hydrocarbon fuel gas containing additive including at least fuel component (iii) according to claim 11.

14. Method according to claim 6, wherein the non-fossil fuel evolved by underwater arcing comprises (i) component hydrogen gas, (ii) component carbon monoxide gas, and (iii) component more massive gases, and including the step of separating out the first and second components by diffusion thereof through a semi-permeable membrane too fine to allow diffusion of all the third component therethrough in a like period of time, and then the step of adding the remaining third component to the hydrocarbon fuel.

15. Method according to claim 14, wherein the semi-permeable membrane comprises rubber commonly used in balloons for helium.

16. Internal-combustion engine fuel additive, comprising at least magnecules evolved in gaseous form by operation of an underwater carbon arc between electrodes.

17. Fuel additive according to claim 16, evolved from such carbon arc totally submerged in water having an overlying surface at substantially ambient atmospheric pressure and temperature.

18. Fuel additive according to claim 16, wherein the additive comprises substantially all of the components of the evolved gaseous fuel mixture so formed by operation of such underwater carbon arc.

19. Fuel additive according to claim 18, comprising (i) hydrogen, (ii) carbon monoxide, and (iii) magnecules.

20. Internal-combustion engine operated on predominantly hydrocarbon fuel plus an amount of the fuel additive according to claim 19 effective to lessen its noxious combustion effluents.

* * * * *